US005261358A

United States Patent [19]

Rorke

[11] Patent Number: 5,261,358

[45] Date of Patent: Nov. 16, 1993

[54] INTERNAL COMBUSTION ENGINE

[75] Inventor: David J. Rorke, Darwin, Australia

[73] Assignee: Aardvark Pty Ltd., Darwin, Australia

[21] Appl. No.: 663,912

[22] PCT Filed: Mar. 20, 1990

[86] PCT No.: PCT/AU90/00114

§ 371 Date: Mar. 7, 1991

§ 102(e) Date: Mar. 7, 1991

[87] PCT Pub. No.: WO90/15230

PCT Pub. Date: Dec. 13, 1990

[30] Foreign Application Priority Data

Jun. 7, 1989 [AU] Australia ..... PJ4623

[51] Int. Cl.[5] ..... F01L 11/00

[52] U.S. Cl. ..... 123/47 R; 123/59 BS

[58] Field of Search ..... 123/47 R, 47 A, 59 BS, 123/65 S

[56] References Cited

U.S. PATENT DOCUMENTS

| | | | |
|---|---|---|---|
| 1,515,529 | 11/1924 | Well | 123/65 S |
| 1,787,856 | 1/1931 | Colter | 123/47 R |
| 1,805,931 | 5/1936 | Taylor | 123/47 R |
| 2,082,078 | 6/1937 | Ottoson | 123/47 R |
| 2,215,793 | 9/1940 | Mayes . | |
| 2,952,252 | 9/1960 | Geatty . | |
| 3,177,853 | 4/1965 | Herdershot | 123/47 R |
| 3,301,234 | 1/1967 | Reilly | 123/47 R |

FOREIGN PATENT DOCUMENTS

| | | | |
|---|---|---|---|
| 751769 | 6/1970 | Belgium . | |
| 596147 | 4/1934 | Fed. Rep. of Germany . | |
| WO90/12952 | 11/1990 | PCT Int'l Appl. | 123/59 BS |
| 140598 | 4/1920 | United Kingdom . | |
| 185143 | 9/1922 | United Kingdom | 123/47 R |

*Primary Examiner*—David A. Okonsky
*Attorney, Agent, or Firm*—Harness, Dickey & Pierce

[57] ABSTRACT

An internal combustion engine comprises a cylinder of stepped configuration having a working portion and a pumping portion and a piston of stepped configuration having a working portion and a pumping portion, the working and pumping portions respectively co-operating to define a combustion chamber and a pumping chamber each of which varies in volume upon reciprocation of the piston in the cylinder. Air is admitted to the pumping chamber through a duct from where, on volume reduction thereof, if passes via a plurality of passages and a one-way valve into a transfer chamber. On volume expansion of the combustion chamber, air in chamber is discharged therefrom via a plurality of passages, common discharge port and valve to scavenge the combustion chamber and provide combustion air. The valve may be self-acting or operated by a crankshaft controlled push-rod. A delivery pump operated pneumatically under the influence of the pumping chamber to deliver fuel or a combustible mixture to inlet passage is also disclosed.

12 Claims, 9 Drawing Sheets

INTERNAL COMBUSTION ENGINE

TECHNICAL FIELD

This invention relates to an internal combustion engine.

The invention has been devised particularly, although not solely, for use as an internal combustion engine operating on a two-stroke cycle.

BACKGROUND ART

With a reciprocating piston engine operating on a two stroke cycle, part of the compression and expansion strokes are used for the purpose of exhaust and induction. It is common for the piston itself to be used to open and close inlet and exhaust ports. On upward movement of the piston, the crankcase is decompressed and a charge of air or combustible mixture is admitted into the crankcase through a self-acting valve. During the expansion stroke the charge of air or combustible mixture in the crankcase is compressed, and near the end of this stroke the exhaust port is uncovered to allow the combustion products to discharge from the combustion chamber. Further movement of the piston uncovers the inlet port and the compressed charge from the crankcase flows into the combustion chamber. The exhaust and inlet ports are open simultaneously for a short period so that the incoming charge can assist in clearing the combustion chamber of combustion products. The cycle is completed by compression and subsequent ignition of the charge trapped in the combustion chamber.

A deficiency of this common arrangement in two-stroke engines is that the process of clearing the combustion products from the combustion chamber and recharging it is restricted, owing to the little time available for induction and exhaust and the fact that for a portion of this time the inlet and exhaust ports are both open, with the result that some incoming charge escapes with the exhausting combustion products.

DISCLOSURE OF INVENTION

The present invention when applied as a two-stroke engine seeks to provide an engine having an improved process of clearing combustion products from the combustion chamber in comparison to the common arrangement described hereinbefore.

In one form the invention resides in an internal combustion engine comprising a cylinder and a piston mounted for reciprocation in the cylinder, the piston and the cylinder co-operating to define a combustion chamber and a pumping chamber each of which varies in volume upon reciprocation of the piston in the cylinder, an inlet means to admit fluid into the pumping chamber, a transfer chamber defined within the piston for receiving and containing fluid from the pumping chamber, and a control means for controlling discharge of the fluid from the transfer chamber into the combustion chamber.

Preferably, the piston includes a transfer passage controlled by a non-return valve to allow delivery of fluid from the pumping chamber to the transfer chamber upon volume reduction of the pumping chamber.

The control means may be of any suitable form such as a discharge passage including a discharge port opening onto the combustion chamber and a valve means for controlling flow through the discharge passage. The valve means may comprise a self-acting valve or valve operable under external control to open and close the discharge port. Where the valve is self-acting valve, it may for example be arranged to operate in response to a predetermined difference in pressure between the combustion and transfer chambers. Where the valve is operable under external control, a control mechanism may for example be provided to operate the valve according to the relative position of the piston in the cylinder. Such a control mechanism may comprise a push-rod for operating the valve, the push rod being operatively connected to a cam on a crankshaft to which the piston is operatively connected.

In a preferred construction of the invention:

(a) the cylinder comprises two cylinder portions being a cylinder Working portion and a cylinder pumping portion, the cylinder pumping portion being larger in cross-sectional area than the cylinder working portion, the cylinder working portion having a wall at one of its ends and opening onto the cylinder pumping portion at the other of its ends, and a further wall interconnecting the adjacent ends of the cylinder working and pumping portions;

(b) the piston comprises a piston working portion and a piston pumping portion, the piston working portion being received in the cylinder working portion and the piston pumping portion being received in the cylinder pumping portion; and (c) said piston working portion and said cylinder working portion co-operating to define said combustion chamber, and said further wall, said cylinder pumping portion and said piston pumping and working portions co-operating to define said pumping chamber.

With this arrangement, the pumping chamber is of annular configuration, the outer circumferential wall of the annular pumping chamber being defined by the circumferential wall of the cylinder pumping portion and the inner circumferential wall of the annular pumping chamber being defined the circumferential wall of the piston working portion.

Where the invention is applied as a two-stroke engine, a charge of air introduced into the combustion chamber from the transfer chamber in the piston performs a scavenging function in the combustion chamber. A combustible mixture may be introduced into the combustion chamber by any suitable arrangement such as an inlet port successively opened and closed by a valve. Similarly, the products of combustion can be exhausted by way of an exhaust port also successively opened and closed by valve. With this arrangement, a stratified charge can be created in the combustion chamber by introducing a fuel-rich combustible mixture into the chamber through the inlet port. The fuel-rich mixture combines with the air introduced via the transfer chamber in the piston to create a combustible mixture which is fuel-rich in the vicinity of ignition means at the time of ignition.

In another induction and exhaust arrangement, inlet and exhaust ports may be opened and closed by the piston.

In still another arrangement, a combustible mixture may be introduced into the combustion chamber from the transfer chamber. This combustible mixture may be the sole combustible mixture in the combustion chamber or may be supplemented either by an additional mixture introduced into the chamber by way of an inlet port or by injected fuel.

Although the invention has been devised particularly for use as a two-stroke engine, it may be applied as a four-stroke engine. Where the invention is applied as a four-stroke engine, a charge of combustible mixture or at least air for combustion may be introduced into the combustion chamber from the pumping chamber via the transfer chamber in the piston.

BRIEF DESCRIPTION OF THE DRAWINGS

The invention will be better understood by reference to the following description of several specific embodiments thereof, as shown in the accompanying drawings in which:-

DESCRIPTION OF PREFERRED EMBODIMENTS

Figure 1:
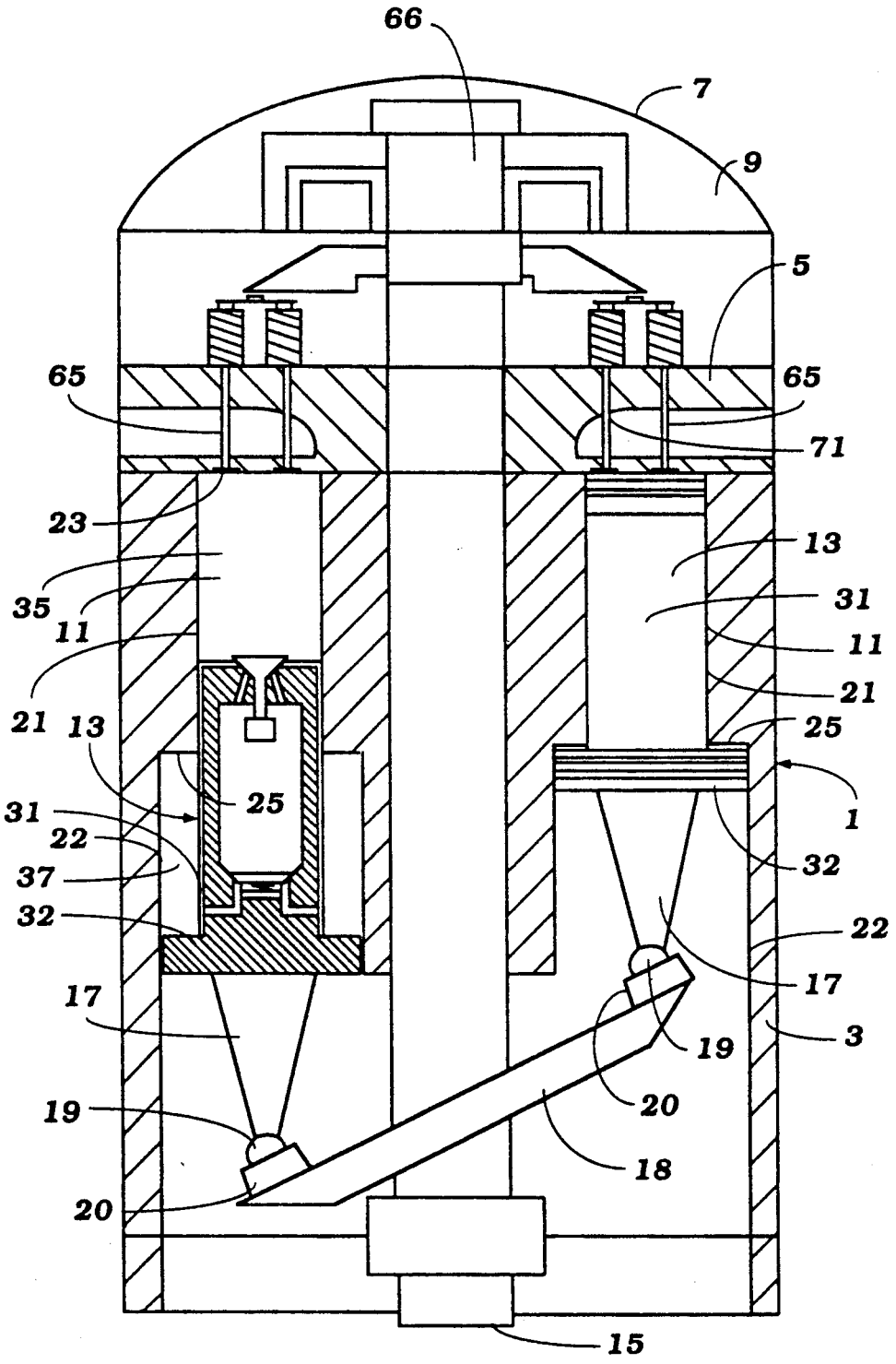
FIG. 1 is a sectional view of an engine according to a first embodiment.
Figure 2:
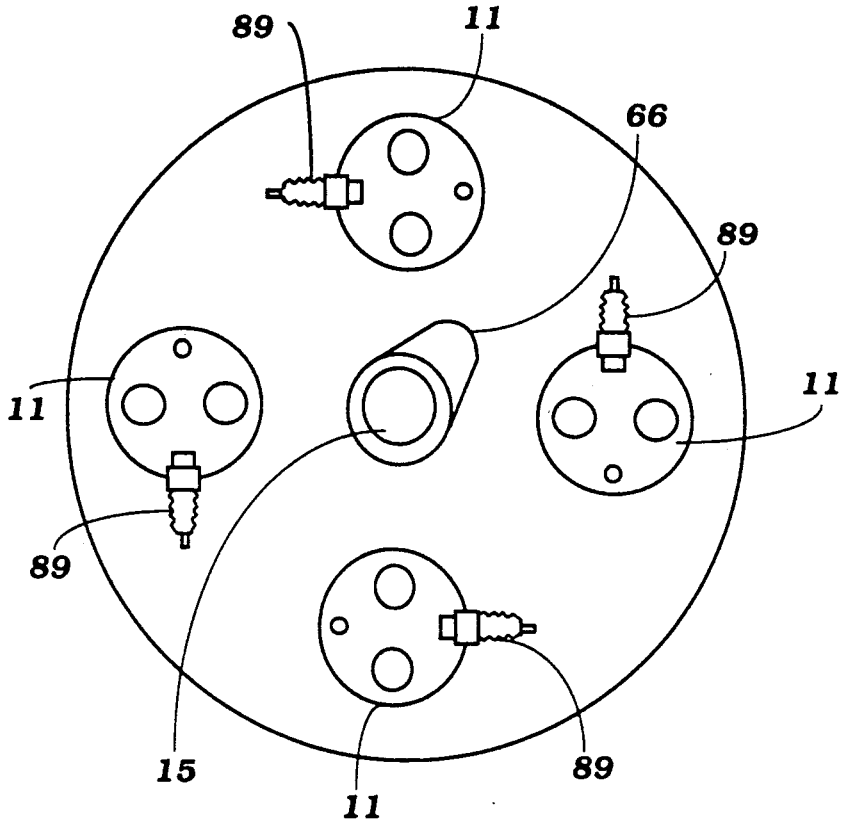
FIG. 2 is a schematic plan view of the engine of FIG. 1 with a top cover removed.

The embodiment shown in FIGS. 1 to 7 of the drawings is directed to an international combustion engine comprising a housing 1 having a block portion 3, a head portion 5 and a removable cover 7 defining a space 9.

A plurality of cylinders 11 are defined within the housing and each has a piston 13 mounted for reciprocation in it. Each piston 13 is operatively connected to a drive shaft 15 by way of a rigid connecting rod 17 and a swash plate 18. The connecting rod 17 is fixed at one end to the piston and is provided with a foot 19 at the other end. The foot 19 is received in a shoe 20 on the swash plate.

The cylinder 11 is of stepped configuration so as to comprise two portions, being a cylinder working portion 21 and a cylinder pumping portion 22. The cylinder pumping portion 22 is of larger cross-sectional area than the cylinder working portion 21, as shown in the drawings. The cylinder working portion 21 has a wall 23 at one of its ends and the two cylinder portions open onto each other at the other end of the cylinder working portion. Where the two cylinder portions open onto each other they are interconnected by a further wall 25 which provides a step in the cylinder 11.

The piston 13 is also of stepped configuration so as to comprise two portions being a piston working portion 31 and a piston pumping portion 32. The piston working portion 31 is received in the cylinder working portion 21 and the piston pumping portion 32 is received in the cylinder pumping portion 22.

The combustion chamber 35 is defined by the piston working portion 31 and the cylinder working portion 21 in cooperation.

An annular pumping chamber 37 is defined by said further wall 25, the cylinder pumping portion 22 and the piston working and pumping portions in co-operation.

The combustion chamber 35 and the pumping chamber 37 vary in volume as the piston 13 undergoes reciprocation in the cylinder 11.

An inlet means 41 is provided to admit air into the pumping chamber 37 as it undergoes an expansion in volume. The inlet means 41 includes an inlet duct 43 opening into the pumping chamber and a valve 45 associated with inlet duct and operable to permit air to flow along the inlet duct into the pumping chamber upon expansion of the pumping chamber while preventing return flow upon volume reduction of the pumping chamber.

A transfer system 44 is provided for selectively transferring air from the pumping chamber 37 to the combustion chamber 35. The transfer system 44 comprises a transfer chamber 47 within the piston 13 to receive air under pressure from the pumping chamber 37 as the latter undergoes a reduction in volume and to contain such air. The transfer chamber 47 receives air from the pumping chamber by way of a plurality of transfer passages 49 formed Within the piston 11. Each transfer passage is in the form of a bore extending through the piston, one end of the bore opening onto the pumping chamber 37 and the other end opening onto the transfer chamber 47 within the piston. A one-way vale 50 is provided in association with the transfer passages 49 for permitting air to flow along the transfer passages from the pumping chamber to the transfer chamber while preventing return flow. The one-way valve 50 comprises a valve member 51 movable into and out of engagement with a valve seat 52 defined within the transfer chamber and closely adjacent the transfer passages 49. The valve member 51 is urged into sealing engagement with the valve seat under the influence of a valve spring 53. The valve member 51 is arranged to be deflected out of engagement with the valve seat 52 under the influence of air pressure generated upon compression of the pumping chamber 37 so as to permit air flow from the pumping chamber to the transfer chamber. The valve member returns into sealing engagement with the valve seat upon termination of the air flow thereby to prevent return flow.

A control means 54 is provided for controlling discharge of air form within the transfer chamber 47 to the combustion chamber 35. The control means 54 comprises a plurality of discharge passages 55 formed in the piston and terminating at a discharge port 57 opening onto the combustion chamber. The control means 53 further comprises a discharge valve 59 for opening and closing the discharge port. In this embodiment the valve 59 is a self-acting valve which opens and closes according to a predetermined pressure difference between the transfer chamber and the combustion chamber. A spring means (not shown) may be provided for biassing the discharge valve 59 into the position in which it closes the discharge port 57.

Air introduced into the combustion chamber 35 from the pumping chamber 37 serves a scavenging function and may also be used for combustion purposes, as will be explained later.

A combustible mixture which is rich in fuel is introduced into the combustion chamber by means of a delivery system 61 including an inlet port 63 which is opened and closed in timed sequence by a valve 65 operated by a cam 66 mounted on the drive shaft within space 9. Similarly, products of combustion discharge from the combustion chamber by a suitable exhaust system 67 including an exhaust port 69 which is opened and closed in timed sequence by a cam-operative valve 71.

The delivery system 61 further includes a delivery pump 63 operable pneumatically under the influence of the pumping chamber 37. The delivery pump 63 comprises a delivery cylinder 65 and a delivery piston 67 mounted for reciprocatory movement along the cylinder. The piston comprises a piston head 69 and a piston rod 71. The piston head 69 divides the cylinder 65 into an intake chamber 73 and a delivery chamber 75. The delivery piston 67 is formed With a plurality of axial passages 77 each controlled by a non-return valve 79 to allow the passage of a fuel-rich mixture from the intake chamber 73 to the delivery chamber 75, as will be explained later.

The delivery chamber 75 communicates with the inlet port 63 by way of a delivery passage 76. A one-way valve 74 is provided in the delivery passage.

An inlet means 77 including an inlet passage 78 is provided for introducing the fuel-rich mixture into the intake chamber 73. Non-return valves 80 are provided to prevent return flow.

The delivery piston 67 is movable along the cylinder in response to differences in fluid pressure acting on the piston. In this regard, the piston rod 71 is slidably supported and guided by guide means 80. The guide means 80 define a conduit 81 which opens onto the pumping chamber 37 so as to expose the delivery piston 67 to fluid pressure in the pumping chamber. With this arrangement, fluid pressure developed in the pumping chamber upon volume reduction of that chamber acts on the delivery piston to influence it to move along the delivery cylinder 65 so as to cause volume reduction of the delivery chamber 75 in order to compress the fuel-rich mixture contained therein. Reversal of the pressure differential on the delivery piston following volume expansion of the pumping chamber influences the delivery piston to move in the reverse direction so as to cause volume expansion of the delivery chamber 75 and volume reduction of the intake chamber 73. Upon volume reduction of the intake chamber 73, fuel-rich mixture contained therein flows through the axial passages 77 in the piston head 69 and into the delivery chamber 75. The valves 79 prevent return flow on subsequent volume reduction of the delivery chamber.

Operation of the engine according to the embodiment will now be described in relation to FIGS. 3 to 7 of the drawings.

Figure 3:
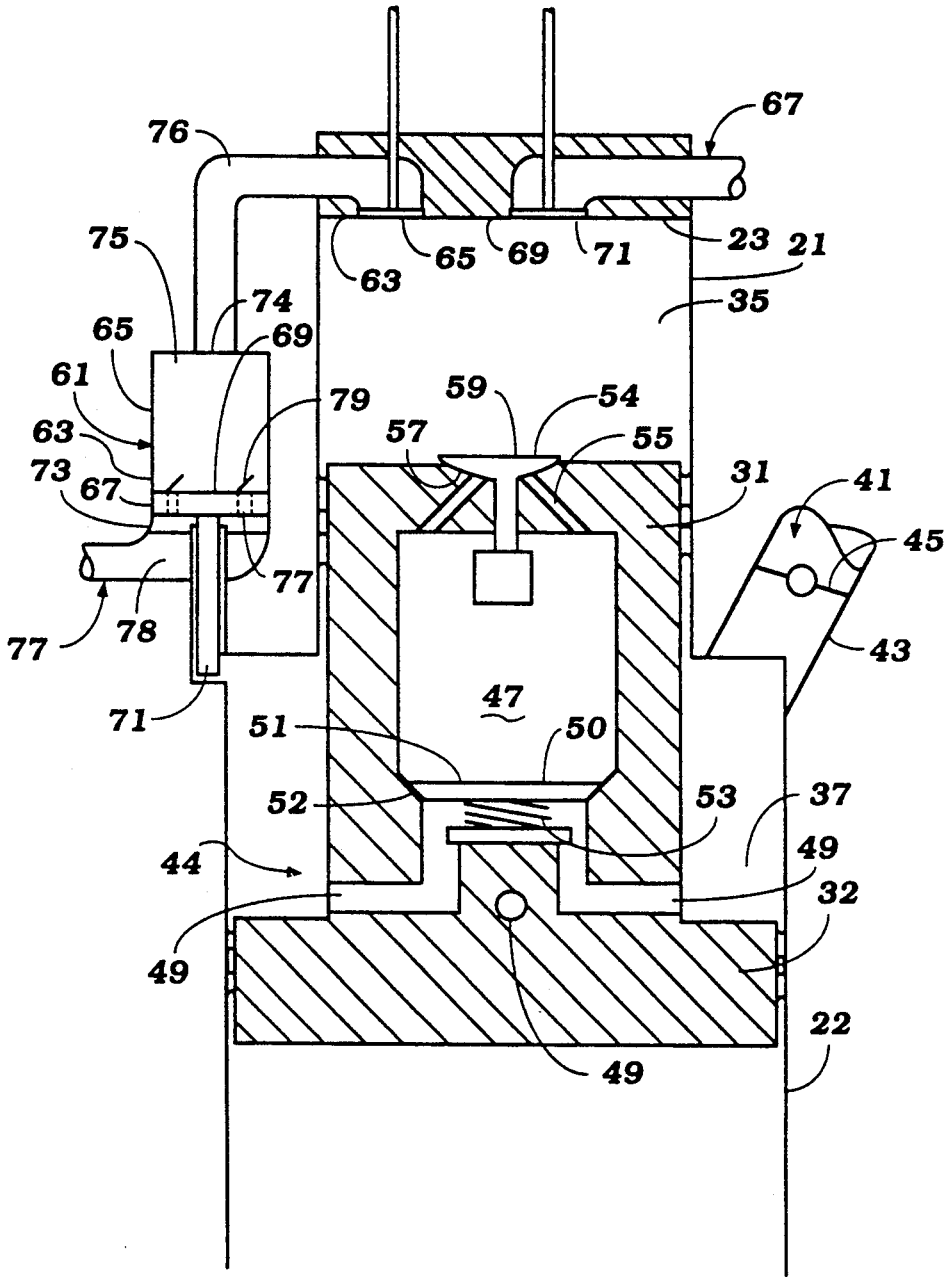
FIGS. 3 to 7 are a series of schematic sectional views illustrating the operational sequence of the engine.

In FIG. 3 the piston 13 has completed its descent in the cylinder 11 and is shown at its bottom dead centre position. At this stage, the pumping chamber 37 has expanded to its maximum volume condition. As the pumping chamber expanded to this conduction, the valve 45 opened and air was induced into the pumping chamber through the inlet port 43. At the same time, fluid pressure acting on delivery piston 67 causes it to move along the delivery cylinder to effect volume reduction of the intake chamber 73. This has the effect of causing a quantity of fuel-rich mixture which was previously admitted into the intake chamber 73 to be transferred into the delivery chamber.

Figure 4:
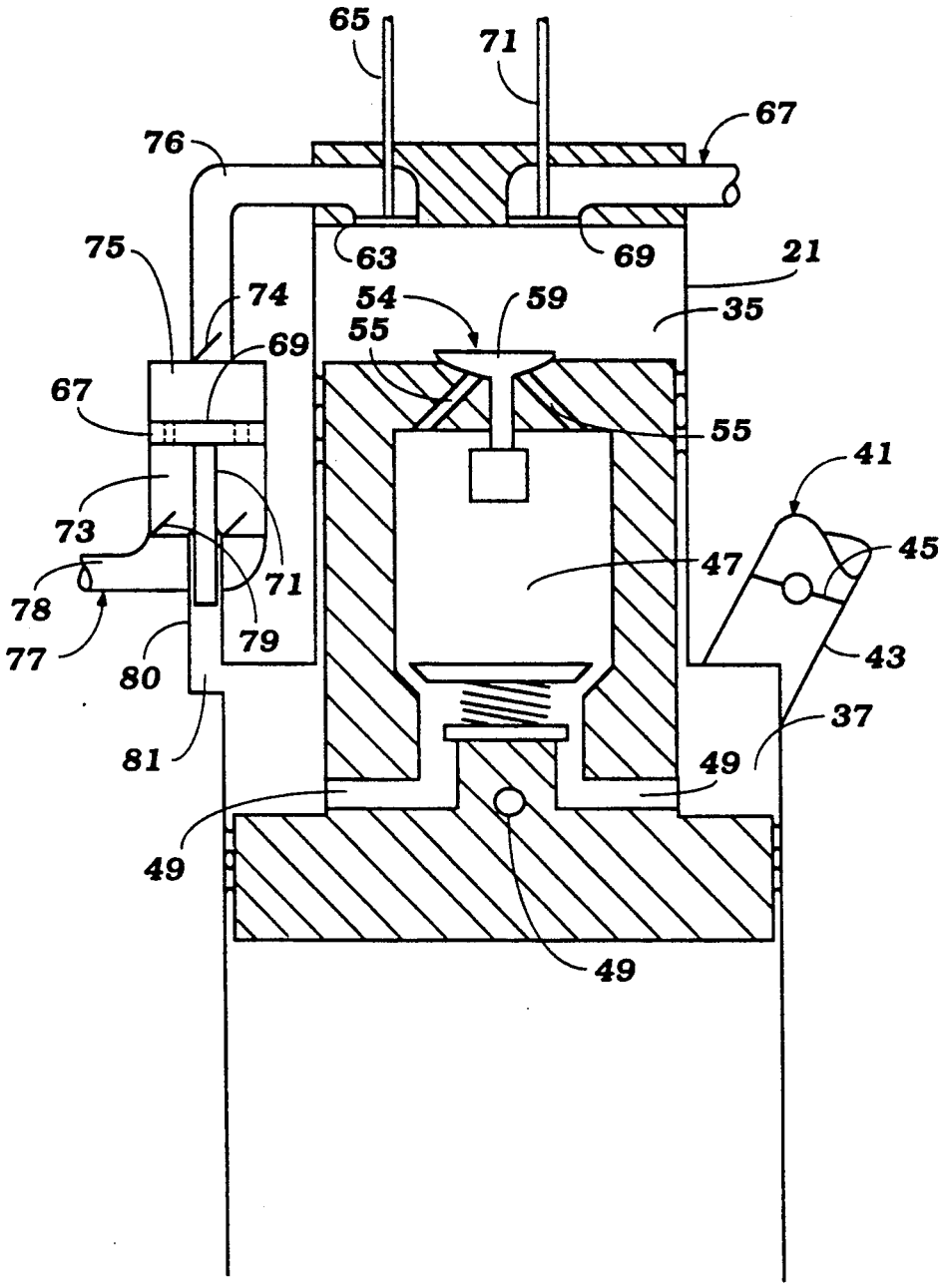

On continued rotation of the drive shaft 15, the piston 13 commences to ascend in the cylinder thereby causing the pumping and combustion chambers to each undergo a progressive reduction in volume, as shown in FIG. 4. The progressive reduction in volume of the pumping chamber causes air contained therein to be forced under pressure along the transfer passages 49 into the transfer chamber 47. The air accumulates in the transfer chamber because at this stage the combustion chamber is undergoing a compression stroke and fluid pressure within the combustion chamber prevents the discharge valve 59 from opening. The progressive reduction of the pumping chamber 37 produces fluid pressure on the delivery piston with the result that it is caused to move along the delivery cylinder to cause volume reduction of the delivery chamber 75. At this stage inlet port 63 is closed by valve 65 and so the fuel-rich mixture is compressed in the delivery chamber and delivery passage 76.

Figure 5:
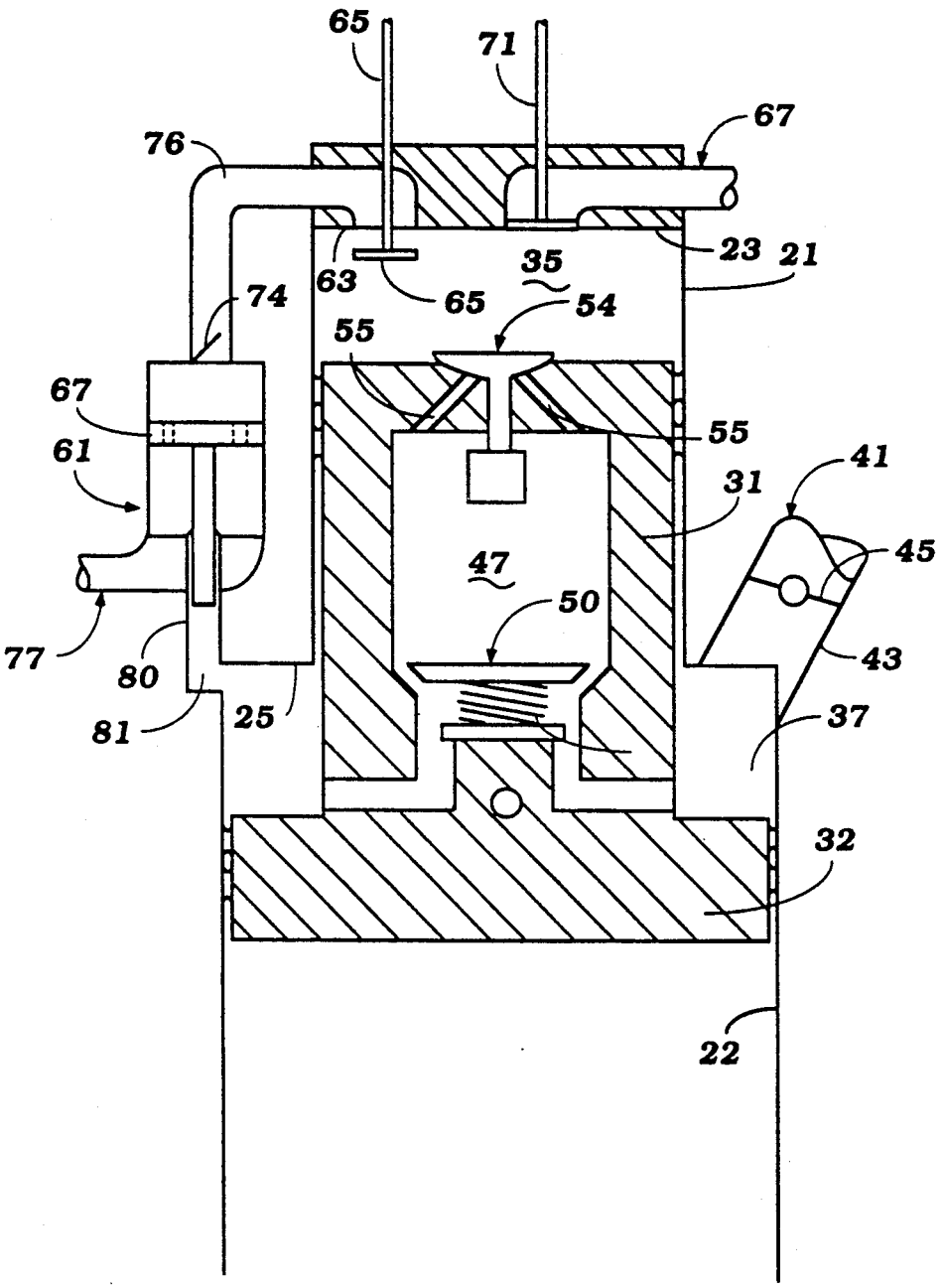

The piston 13 is shown in FIG. 5 approaching its top dead-centre position. The inlet port 63 opens to deliver the fuel-rich mixture under pressure into the combustion chamber. The fuel-rich mixture combines with combustion air which was previously introduced and compressed in the combustion chamber, to create a stratified charge.

Figure 6:
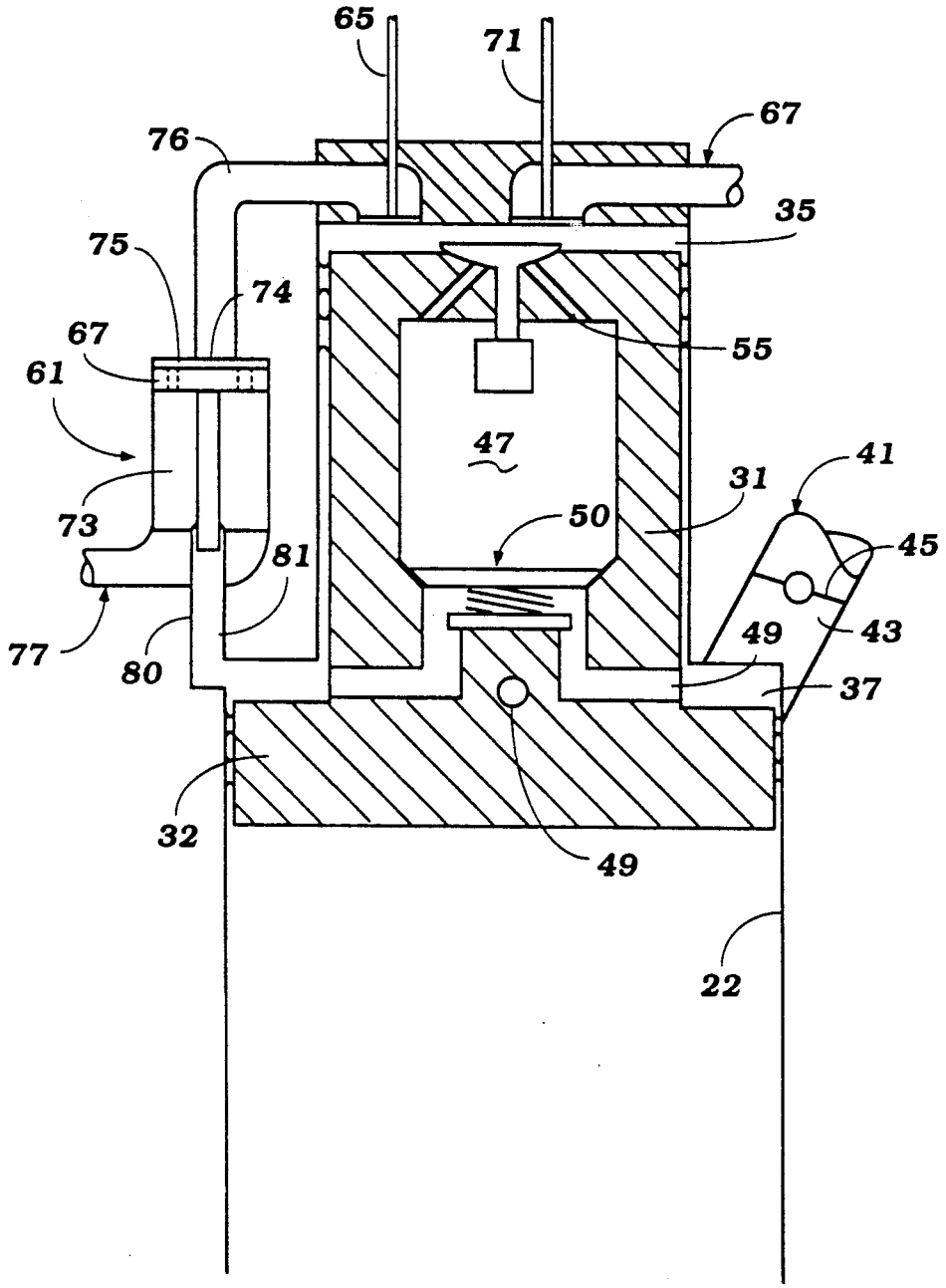

As shown in FIG. 6, the inlet valve then closes and ignition occurs in the combustion chamber under the action of an ignition means 89 (such as a spark plug) and expanding combustion gases in the combustion chamber force the piston to descend in the cylinder.

Figure 7:
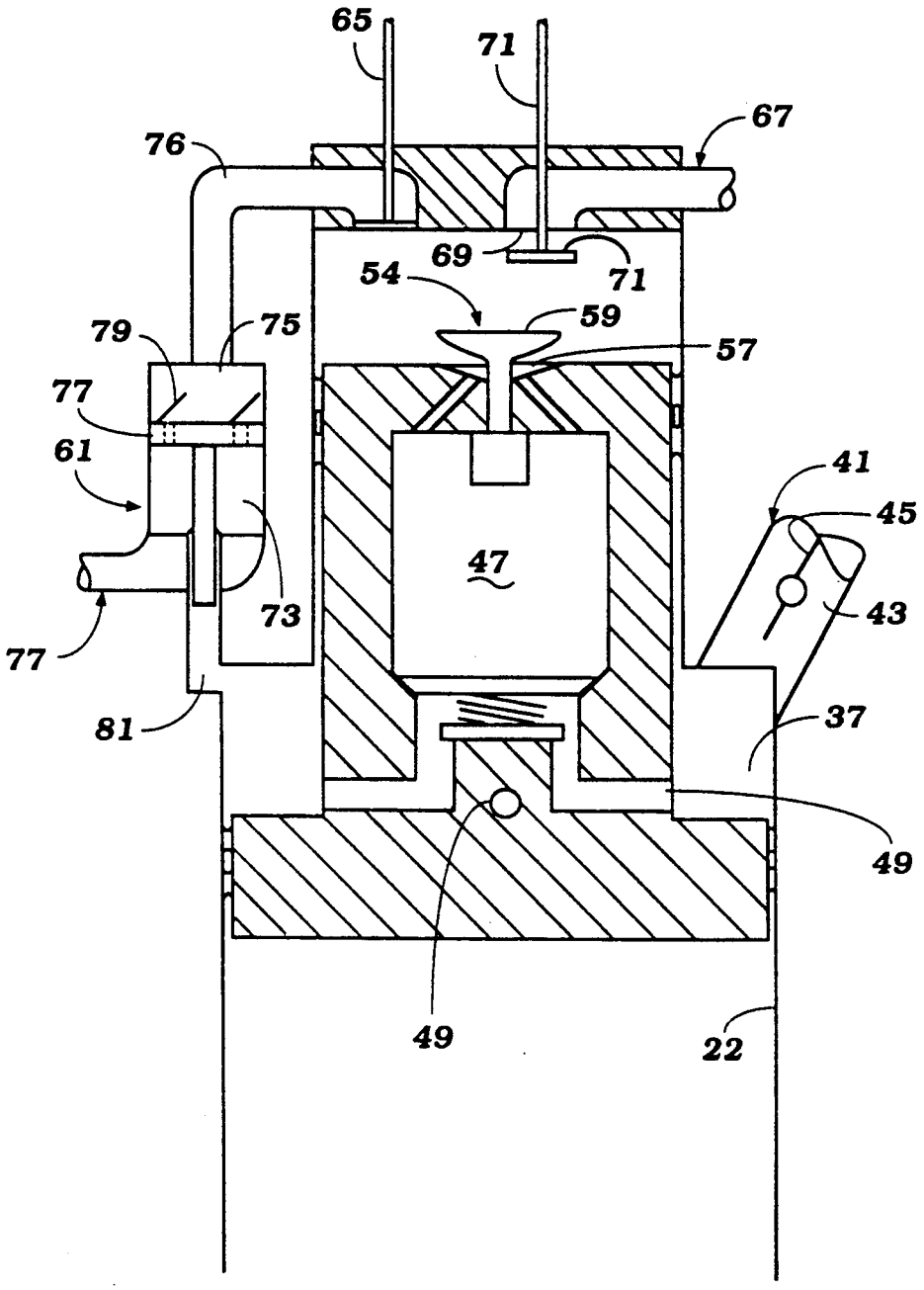

During the descent of the piston, the exhaust port 69 opens to permit the products of combustion to exhaust from the combustion chamber, as shown in FIG. 7.

As the combustion chamber expands and the products of combustion exhaust from the combustion chamber, there is reduction in fluid pressure in the combustion chamber. The resultant difference between the pressure within the combustion chamber and the pressure in the transfer chamber in the piston, and together with inertia effects, causes the discharge valve 59 to open and so allow air contained under pressure in the transfer chamber to enter the expanding combustion chamber. The air entering the combustion chamber scavenges that chamber. The exhaust 12 port 69 then closes as the piston approaches its lowermost position.

During the descent, the pumping chamber 37 undergoes volume expansion and so air is induced into it through the inlet port 43. The cycle is then repeated.

The air which enters the combustion chamber from the transfer chamber in the piston is very effective in scavenging the combustion chamber. Additionally, there is little or no fuel loss during scavenging as fuel is introduced separately after scavenging has been completed or at least almost completed.

While the first embodiment has been described in relation to an engine in which the pistons are operably connected to the drive shaft by way of a swash-plate mechanism, it will be understood that the engine could have employed a conventional crank assembly for such purpose.

Figure 11:
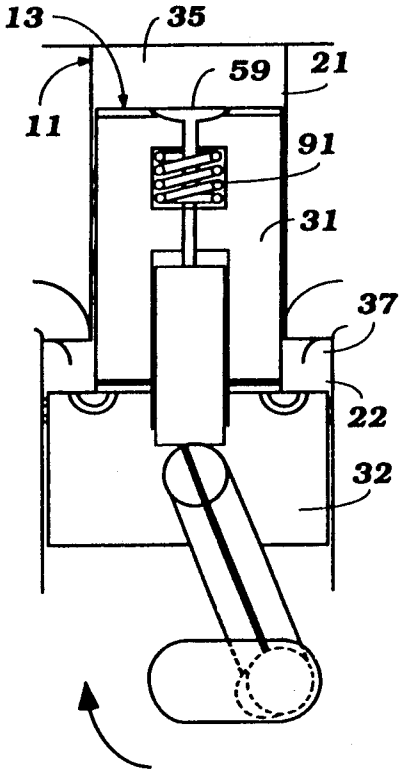
FIGS. 8 to 11 are a series of schematic sectional views illustrating the operational sequence of an engine according to a second embodiment.
Figure 10:
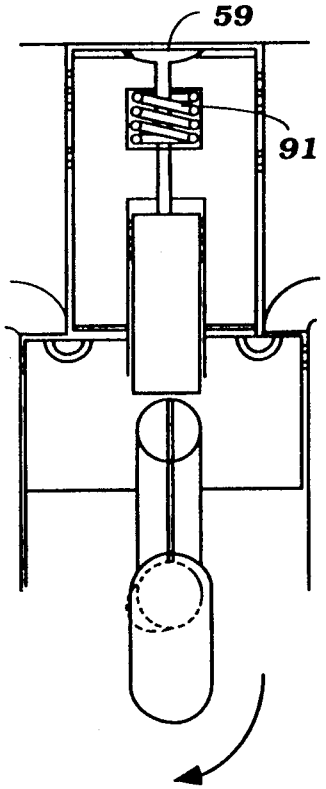
Figure 9:
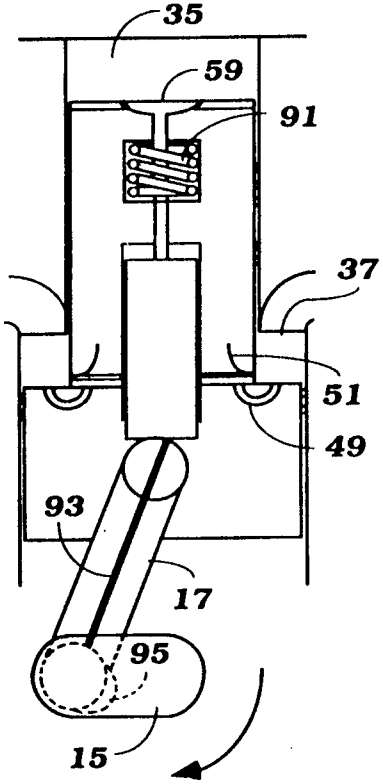
Figure 8:
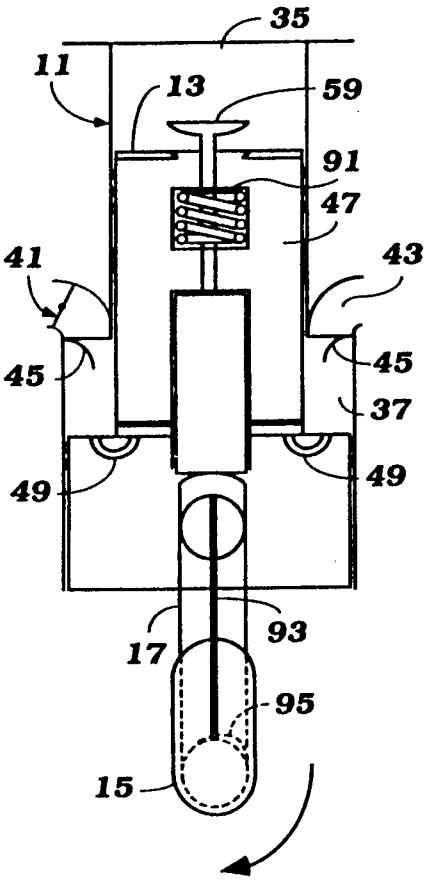

Referring now to FIGS. 8 and 11 of the accompanying drawings, the internal combustion engine according to the second embodiment is similar to the engine of the first embodiment except for operation of the discharge vale 59 and employment of a crank assembly.

In this embodiment, the discharge valve 59 is not self acting as was the case within the first embodiment but rather is operated under external control. Specifically, the discharge valve 59 is biassed into a closed position by a spring 91 and is cause to open in time sequence by a push rod 93 which acts on the valve. The push rod is accommodated in a passage within the connecting rod 17 and is actuated by a cam 95 mounted on the crankshaft 15.

The engine according to the second embodiment operates in a manner similar to the engine of the first embodiment, as can be seen from the drawings.

Figure 12:
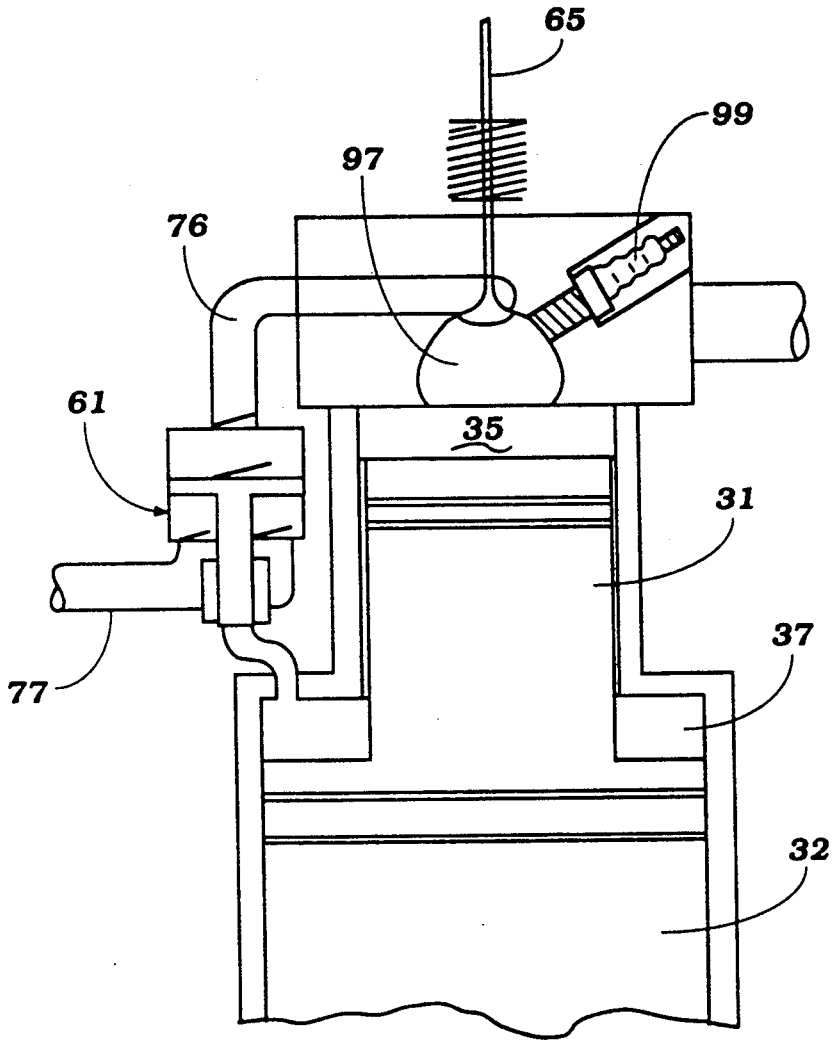
FIG. 12 is a schematic sectional view of part of an engine according to a third embodiment.

Referring now to FIG. 12 of the drawings, there is shown a further embodiment which is similar to the first embodiment with the exception that the combustion chamber 35 includes an auxiliary region 97 into which the fuel-rich mixture is delivered so that the combustible mixture is controlled to be rich in fuel in the vicinity of the ignition means 99 at the time of ignition.

It should be appreciated that the scope of the invention is not limited to the scope of the various embodiments described.

The claims defining the invention are as follows: I claim:

1. An internal combustion engine comprising a cylinder and a piston mounted for reciprocation in the cylinder, the piston and the cylinder co-operating to define a combustion chamber and a pumping chamber each of which varies in volume upon reciprocation of the piston in the cylinder, an inlet means to admit atmospheric air into the pumping chamber, a transfer chamber defined within the piston for receiving and containing atmospheric air from the pumping chamber, a control means for controlling discharge of the atmospheric air from the transfer chamber into the combustion chamber and means independent of said transfer chamber for transferring a rich fuel air mixture into the combustion chamber.

2. An engine according to claim 1 wherein the piston includes a transfer passage controlled by a non-return valve to allow delivery of fluid from the pumping chamber to the transfer chamber upon volume reduction of the pumping chamber.

3. An engine according to claim 1 wherein the control means comprises a discharge passage including a discharge port opening onto the combustion chamber and a valve means for controlling flow through the discharge passage.

4. An engine according to claim 3 wherein the valve means comprises a self-acting valve.

5. An engine according to claim 4 wherein the self-acting valve is adapted to operate in response to a predetermined pressure differential between the combustion chamber and the transfer chamber.

6. An engine according to claim 3 wherein the valve means comprises a valve operable under external control to open and close the discharge port.

7. An engine according to claim 1 wherein the cylinder comprises two cylinder portions being a cylinder working portion and a cylinder pumping portion, the cylinder pumping portion being larger in cross-sectional area than the cylinder working portion, the cylinder working portion having a wall at one of its ends and opening onto the cylinder pumping portion at the other of its ends, and a further wall interconnecting the adjacent ends of the cylinder working and pumping portions; and wherein the piston comprises a piston working portion and a piston pumping portion, the piston working portion being received in the cylinder working portion and the piston pumping portion being received in the cylinder pumping portion: said piston working portion and said cylinder working portion co-operating to define said combustion chamber, and said further wall, said cylinder pumping portion and said piston pumping and working portions co-operating to define said pumping chamber.

8. An engine according to claim 7 wherein said transfer passage includes an inlet end opening onto the side wall of the piston working portion at a location adjacent to the piston pumping portion.

9. An engine according to claim 7 wherein there are a plurality of said transfer passages.

10. An engine according to claim 9 wherein said non return valve is common to all of the transfer passages.

11. An engine according to claim 1 wherein the means for introducing the rich fuel air mixture into the combustion chamber comprises an inlet port adapted to be successively opened and closed by a valve.

12. An engine according to claim 11 wherein the means for delivering the rich fuel air mixture further includes a delivery pump to deliver the mixture to the inlet port, the delivery pump being operable pneumatically under the influence of the pumping chamber.

* * * * *

UNITED STATES PATENT AND TRADEMARK OFFICE

CERTIFICATE OF CORRECTION

PATENT NO. : 5,261,358

DATED : November 16, 1993

INVENTOR(S) : David J. Rorke

It is certified that error appears in the above-identified patent and that said Letters Patent is hereby corrected as shown below:

Item [57], col. 2,

ON THE TITLE PAGE, in the Abstract, line 10, "if" should be — it —.

Column 2, line 14, "Working" should be — working —.

Column 3, line 27, "international" should be — internal —.

Column 4, line 14, "Within" should be — within —.

Column 4, line 18, "vale" should be — valve —.

Column 4, line 37, "form" should be — from —.

Column 4, line 61, "including" should be — includes —.

Column 5, line 4, "With" should be — with —.

Column 6, line 31, after "exhaust" delete "12".

Column 6, line 52, "vale" should be — valve —.

Column 6, line 57, "cause" should be — caused —.

UNITED STATES PATENT AND TRADEMARK OFFICE

CERTIFICATE OF CORRECTION

PATENT NO. : 5,261,358
DATED : November 16, 1993
INVENTOR(S) : David J. Rorke

It is certified that error appears in the above-indentified patent and that said Letters Patent is hereby corrected as shown below:

Column 8, line 17, Claim 7, ":" should be —; —.

Signed and Sealed this

Twenty-second Day of November, 1994

*Attest:*

Bruce Lehman

BRUCE LEHMAN

*Attesting Officer*

*Commissioner of Patents and Trademarks*